United States Patent [19]

Gerry

[11] 4,140,947

[45] Feb. 20, 1979

[54] ALTERNATOR ENERGIZED IGNITION SYSTEM

[76] Inventor: Martin E. Gerry, 13452 Winthrope St., Santa Anna, Calif. 92705

[21] Appl. No.: 814,206

[22] Filed: Jul. 11, 1977

[51] Int. Cl.[2] ..... H05B 37/02; H05B 39/04; H05B 41/36

[52] U.S. Cl. ..... 315/209 R; 123/148 E; 315/166; 315/170; 315/176

[58] Field of Search ..... 315/209 R, 209 T, 209 M, 315/213, 172, 214, 176, 215, 216, 170, 171, 209 CD, 166, 167; 307/264; 123/148 E, 148 DC; 361/253, 263

[56] References Cited

U.S. PATENT DOCUMENTS

| | | | |
|---|---|---|---|
| 3,026,451 | 3/1962 | Richardson | 315/172 |
| 3,087,000 | 4/1963 | Krone | 315/209 M |
| 4,033,316 | 7/1977 | Birchenough | 315/176 |

*Primary Examiner*—Saxfield Chatmon, Jr.

[57] ABSTRACT

An alternator energized ignition system is provided for producing a transient ringing waveform forced by high voltage output of the alternator. A configuration of this system also provides for feeding DC power to result in the conventional transient that modulates the transient ringing waveform to produce very high ignition energy economically.

9 Claims, 3 Drawing Figures

ALTERNATOR ENERGIZED IGNITION SYSTEM

BACKGROUND OF THE INVENTION

This invention is in the field of ignition systems, and particularly in AC powered ignition systems that modulate a typically DC created transient.

No art is known in this field.

SUMMARY OF THE INVENTION

An ignition system comprises an alternator having means for transfering AC power. An ignition transformer has its primary winding coupled to the alternator. A capacitor is provided in circuit with the primary winding for intermittently shunting the primary winding.

The timer is electrically connected to the capacitor and intermittently shunts same during operative mode of the system, except in one configuration where the capacitor is permitted to charge and take on initial conditions. The timer comprises an electrically conductive disk having a plural number of electrically insulative inserts, one insert for each engine cylinder in the system, where the inserts are evenly spaced at the periphery of the disk and within its confines. A number of couplers are provided in cooperation with the disk periphery.

The means for transferring AC power is generally a coupling transformer with a high step up turns ratio providing a high voltage output at its secondary.

The alternator has at least one phase, and the coupling transformer has at least one input winding for making connection to said at least one phase.

DETAILED DESCRIPTION

Figure 1:
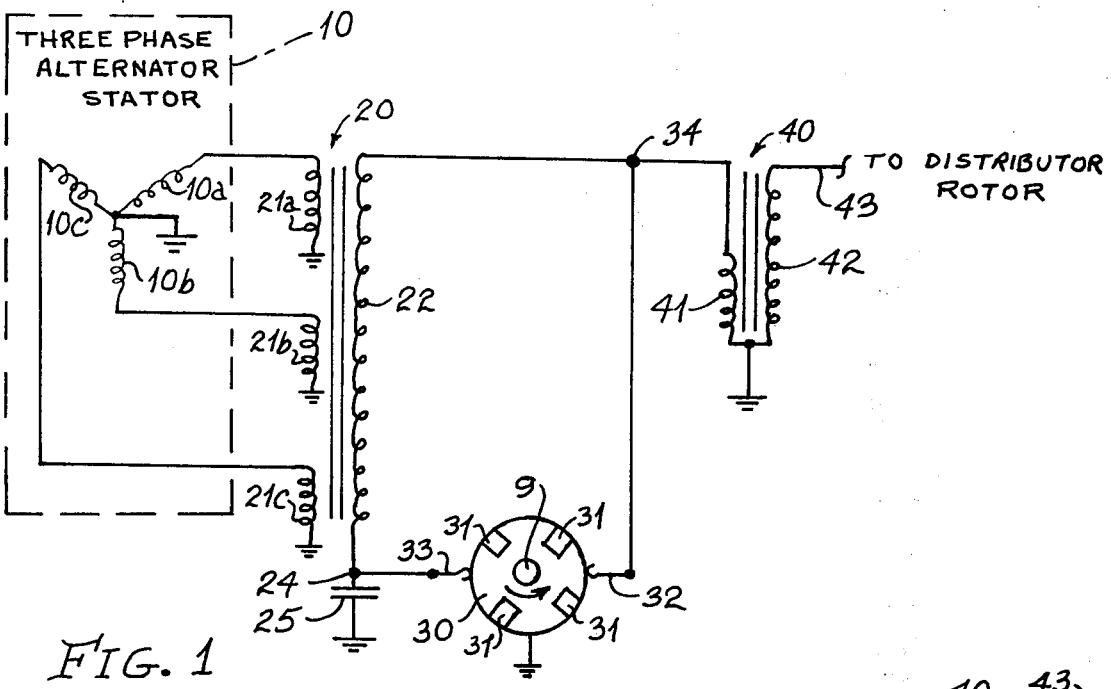
FIG. 1 is an electrical schematic of the system according to the invention.

Referring to FIG. 1, a stator 10 of an alternator is generally provided with three phases having windings 10*a*, 10*b* and 10*c* spaced 120° apart. The rotor thereof is not shown but is common to the industry of automotive equipment. Such alternators may be provided with a frequency range between two and ten kilohertz, although a 60 hertz alternator would also suffice since the circuit is analogous to the typical Kettering circuit in part.

In this application, although the alternator is shown with three phases, it should be understood that a single phase alternator will also operate satisfactorily.

Throughout this description and drawings, the conventional ground symbol is used to indicate both AC and DC return electrical paths, and such should be understood and need not be referred to hereinbelow.

The phases 10*a*, 10*b* and 10*c* are respectively electrically connected to input windings 21*a*, 21*b* and 21*c* of transformer 20. Secondary winding 22 of the transformer provides an AC output feeding the ignition transformer, and the turns ratio of the coupling transformer 20 may provide voltage output across winding 22 of as much as 1000 volts.

Capacitor 25 is connected between junction 24 of secondary 22 and ground. The other side of winding 22 is connected to junction 34 and the input to primary winding 41 of ignition transformer 40. Secondary winding 42 is connected by means of wire 43 to distributor rotor (of a distributor which is not shown but is a conventional connection to a commonly used high voltage distributor in ignition systems).

Capacitor 25 has a dual function. One function, when electrically in circuit with windings 22 and 41, is to match the impedances therebetween during operative mode of the system, that is when igniters are firing. Another function is to provide a ringing transient upon switching action of timer 30.

Timer 30 is a substitute for conventional points, a light emitting switch or a magnetic pulse switch, providing a simple, reliable and inexpensive timing means. The timer disk 30 of electrically conductive material is driven by distributor shaft 9. Disk 30 has electrically insulating inserts 31 regularly spaced about the periphery of the disk within its confines. Contactors or couplers 32 and 33, 180° disposed from each other, are in cooperation with the disk periphery, and consequently when the contactors are in cooperation with the electrically conductive portions of the disk they provide ground to contactors 32 and 33, thereby grounding junctions 24 and 34, short circuiting capacitor 25 and providing an electrical shunting path between junction 34 and ground thereby inhibiting transfer of energy from primary 41 to secondary 42 until disk 30 is driven so that contactors 32 and 33 are positioned in cooperation with inserts 31. At that time the AC energy stored in winding 22, which is an initial condition together with AC power provided by the alternator by virtue of winding 22 feeding primary 41, will provide a ringing signal of high voltage induced in winding 22 plus the steady state voltage available across winding 22, both to be transferred from primary 41 to secondary 42 and be applied to the particular igniter then connected through the distributor to fire same.

Considering a single phase of the voltage provided by the alternator, the equation for the phenomena just prior to firing of an igniter, may be written in Laplace transform terms as follows:

$$(A\omega/s^2 + \omega^2) + L_{22}i_a = [(L_{22} + L_{41})s + R + 1/Cs]\, I(s) \qquad (1)$$

where $(A\omega/s^2 + \omega^2)$ is the Laplace transform of the sinusoidal voltage A sin $\omega t$, $L_{22}i_a$ is the initial voltage residual in winding 22 due to AC current from the alternator, $L_{22}$ and $L_{41}$ are the values of windings 22 and 41 in henries R is the total circuit resistance in ohms, C is the value in farads of capacitor 25, and s is a complex number that can be regarded as an operator to convert a time domain expression into the complex or frequency domain.

The solution of (1) for I(s) is the current flowing in windings 22 and 41 and is in the time domain and is of the form:

$$i(t) = k_1e^{-\alpha t} + k_2e^{-\beta t} + k_3 \sin(\omega t + \phi) \qquad (2)$$

where $k_1$, $k_2$, $k_3$, $\alpha$, $\beta$ and $\phi$ are given in terms of the values of the parameters in (1). The exact solution is not necessary herein but may be found by use of a good transform table, by complex integration or by use of the Residue Theorem. However, it can be seen from (2) that two decaying exponential terms of different decay rates will be additive with a sine function that has a constant phase angle as part thereof, and the overall result will be a ringing sinusoid with a peak value at or close to time = zero, or when contactors 32 and 33 have just been positioned from their contact position with the electrically conductive portions of disk 30 to the electrically insulative portions 31.

Figure 2:
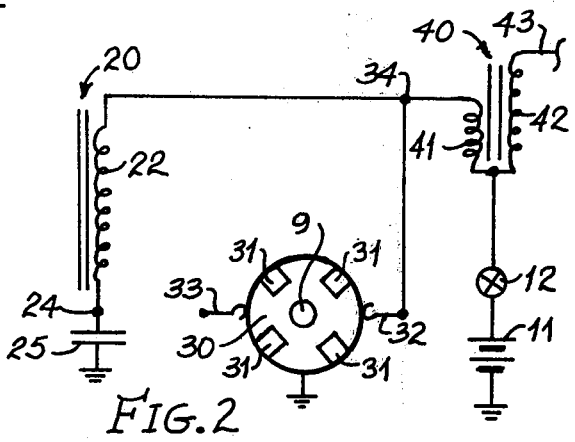
FIG. 2 is a partial electrical schematic of the system of FIG. 1 modified to delete means for intermittently shunting the capacitor therein and adding DC power thereto.

Referring to FIG. 2, the differences between this configuration and that of FIG. 1, is that battery 11 herein provides, through ignition switch 12, DC power to primary 41 at its terminal opposite to the terminal connected to junction 34, and that contactor 33 is not connected to junction point 24.

Hence, primary winding 41 will be charged with DC during the periods when contactor 32 is in cooperation with the electrically conductive portions of disk 30, to provide a initial condition due to DC power in primary 41. Absence of connection between contactor 33 and junction 24 will also create an initial charge condition due to the AC from the alternator in capacitor 25, with the result that the behavior of the system may be stated in Laplace transform notation as:

$$\frac{A\omega}{s^2+\omega^2} + L_{22}i_a - \frac{q_a}{Cs} + L_{41}i_d + \frac{V}{s} = [(L_{22}+L_{41})s + R + \frac{1}{Cs}]\,I(s) \quad (3)$$

wherein the same terms as in (1) are identically defined, $L_{41}i_d$ is the initial voltage due to charge of primary 41 with DC, V/s is a step function due to presence of battery 11 in the circuit, and $q_a/Cs$ is the initial charge stated as a voltage due to AC residual in capacitor 25.

The solution will be of the same form as stated in (2), except that the component values therein will be different in that there is an increase in current contributed by the added voltages $L_{41}i_d$ and V/s, and a decrease due to the voltage of the charged capacitor $q_a/Cs$.

Figure 3:
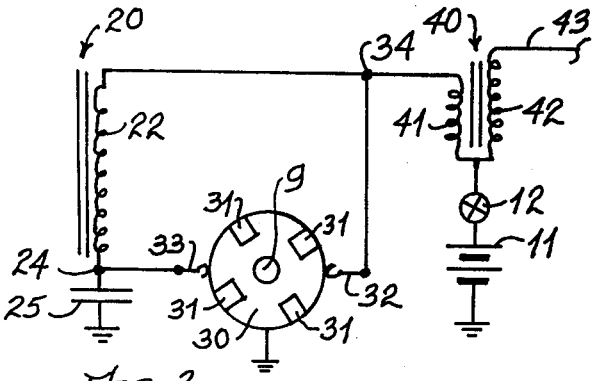
FIG. 3 is a partial electrical schematic of the system of FIG. 1 modified to add DC power thereto.

Referring to FIG. 3, the differences between this configuration and that of FIG. 1, is that herein battery 11 provides, through ignition switch 12, DC power to primary 41 at ts terminal opposite to the terminal connected to junction 34.

Hence, primary winding 41 will be charged with DC during the periods when contactor 32 is in cooperation with the electrically conductive portion of disk 30, to provide an initial condition due to DC power in primary 41. The connection of contactor 33 to junction 24 will prevent the undesirable initial charge of capacitor 25 due to AC from the alternator, so that the behavior of the system may be stated in Laplace transform format as:

$$\frac{A\omega}{s^2+\omega^2} + L_{22}i_a + L_{41}i_d + \frac{V}{s} = [(L_{22}+L_{41})s + R + \frac{1}{Cs}]\,I(s) \quad (4)$$

Examination of equation (4) shows the absence of initial condition due to the charge of capacitor 25 by the AC power since same prior to firing mode had been short circuited, and provides the same type of solution as given in (2) except that the current due to this configuration will be the highest of all the configurations.

With reference to basic concepts, FIG. 1 provides a similar situation as the Kettering system with advantages of using AC feed where voltage can be readily increased by transformer coupling to increase the energy output. In FIGS. 2 and 3 the advantage of use of AC is further multiplied by the intermodulation of the AC with the transient provided by switching action of the timer.

What is claimed is:

1. An ignition system comprising the combination of:
- an alternator having a coupling transformer connected thereto for transferring AC power;
- an ignition transformer having a primary winding, said primary winding being electrically coupled to the coupling transformer;
- a capacitor, in series circuit with the primary winding, said capacitor, coupling transformer and primary winding comprising a primary circuit; and
- a timer connected only to said primary circuit for intermittently shunting the primary winding.

2. The invention as stated in claim 1, wherein said timer comprises an electrically conductive disk having a plural number of electrically insulative inserts evenly spaced at the periphery of the disk and within the confines thereof, and having a plural number of couplers in cooperation with said periphery, one of said couplers providing intermittent shunting of said capacitor.

3. The invention as stated in claim 1, wherein said alternator has at least one phase and wherein said coupling transformer has at least one input winding for making connection to said at least one phase.

4. The invention as stated in claim 1, wherein said primary winding is DC powered.

5. The invention as stated in claim 4, wherein said timer comprises an electrically conductive disk having a plural number of electrically insulative inserts evenly spaced at the periphery of the disk and within the confines thereof, and having a coupler in cooperation with said periphery.

6. The invention as stated in claim 4, wherein said alternator has at least one phase and wherein said coupling transformer has at least one input winding for making connection to said at least one phase.

7. The inventin as stated in claim 1, wherein said primary winding is DC powered and wherein said timer is electrically connected to the capacitor for intermittently shunting same.

8. The invention as stated in claim 7, wherein said timer comprises an electrically conductive disk having a plural number of electrically insulative inserts evenly spaced at the periphery of the disk and within the confines thereof, and having a plural number of couplers in cooperation with said periphery.

9. The invention as stated in claim 7, wherein said alternator has at least one phase and wherein said coupling transformer has at least one input winding for making connection to said at least one phase.

* * * * *